US009534877B2

(12) United States Patent
Huffman et al.

(10) Patent No.: US 9,534,877 B2
(45) Date of Patent: Jan. 3, 2017

(54) LOW ENERGY MECHANICAL OPERATING CARTRIDGE

(71) Applicant: PDT Tech, LLC, Alamo, CA (US)

(72) Inventors: Rick Huffman, Redwood Valley, CA (US); David Kline, Long Beach, CA (US)

(73) Assignee: PDT Tech, LLC, Alamo, CA (US)

( * ) Notice: Subject to any disclaimer, the term of this patent is extended or adjusted under 35 U.S.C. 154(b) by 0 days.

(21) Appl. No.: 14/154,007

(22) Filed: Jan. 13, 2014

(65) Prior Publication Data

US 2014/0196625 A1 Jul. 17, 2014

Related U.S. Application Data

(60) Provisional application No. 61/752,337, filed on Jan. 14, 2013.

(51) Int. Cl.

| | |
|---|---|
| ***F42B 12/36*** | (2006.01) |
| ***F42B 8/02*** | (2006.01) |
| ***F42B 5/067*** | (2006.01) |
| ***F42B 5/045*** | (2006.01) |

(52) U.S. Cl.

CPC ..... *F42B 12/36* (2013.01); *F42B 5/045* (2013.01); *F42B 5/067* (2013.01); *F42B 8/02* (2013.01)

(58) Field of Classification Search

USPC ..... 102/430, 439, 444, 446, 447, 464

See application file for complete search history.

(56) References Cited

U.S. PATENT DOCUMENTS

| | | | | | |
|---|---|---|---|---|---|
| 3,477,375 | A * | 11/1969 | Barr | F42B 5/02 102/470 |
| 3,713,386 | A | 1/1973 | Zaid | |
| 4,173,186 | A * | 11/1979 | Dunham | 102/430 |
| 4,867,065 | A | 9/1989 | Kaltmann et al. | |
| 5,359,937 | A | 11/1994 | Dittrich | |
| 5,492,063 | A | 2/1996 | Dittrich | |
| 5,677,505 | A | 10/1997 | Dittrich | |
| 6,095,051 | A * | 8/2000 | Saxby | 102/444 |
| 6,178,889 | B1 * | 1/2001 | Dindl | 102/447 |
| 6,324,983 | B1 * | 12/2001 | Dindl | 102/447 |
| 6,439,123 | B1 | 8/2002 | Dionne | |
| 6,575,098 | B2 * | 6/2003 | Hsiung | 102/498 |
| 7,021,219 | B1 | 4/2006 | Dindl | |
| 7,225,741 | B2 * | 6/2007 | Huffman | 102/434 |

(Continued)

FOREIGN PATENT DOCUMENTS

| | | |
|---|---|---|
| FR | 2394779 | 1/1979 |
| WO | PCT/US14/11344 | 7/2014 |

*Primary Examiner* — Benjamin P Lee

(74) *Attorney, Agent, or Firm* — Brian Beverly; Beeson Skinner Beverly, LLP

(57) ABSTRACT

A low energy mechanical operating cartridge has an inner regulator core (13) supporting a projectile (21) slidably engaged in a primer casing (19). The regulator core acts to control the velocity at which the projectile is propelled from a firearm (61), and the primer casing carries the explosive propellant (25) necessary to generate the required energy to launch the projectile. To improve the operation of the cartridge and ejection of the cartridge from the firearm, the primer casing is configured to efficiently slide on the regulator core in a rearward recoil action, while robust gas seals are maintained between the casing and regulator core.

28 Claims, 6 Drawing Sheets

(56) References Cited

U.S. PATENT DOCUMENTS

| | | | | |
|---|---|---|---|---|
| 7,814,836 | B2 * | 10/2010 | Saxby | 102/444 |
| 7,984,668 | B2 * | 7/2011 | Huffman | F42B 5/045 102/433 |
| 8,146,505 | B2 | 4/2012 | Huffman | |
| 8,327,767 | B2 * | 12/2012 | Lafortune | 102/439 |
| 8,365,669 | B1 * | 2/2013 | Saxby | 102/430 |
| 8,485,102 | B2 * | 7/2013 | Carlson et al. | 102/513 |
| 2002/0162475 | A1 * | 11/2002 | Saxby | 102/446 |
| 2007/0199470 | A1 * | 8/2007 | Huffman | 102/447 |
| 2010/0236442 | A1 * | 9/2010 | Huffman | F42B 5/045 102/444 |
| 2010/0269724 | A1 | 10/2010 | Head et al. | |
| 2011/0252999 | A1 | 10/2011 | Carlson et al. | |
| 2012/0017793 | A1 | 1/2012 | Huffman | |
| 2012/0192751 | A1 | 8/2012 | Lafortune | |
| 2013/0047881 | A1 * | 2/2013 | Saxby | 102/444 |

* cited by examiner

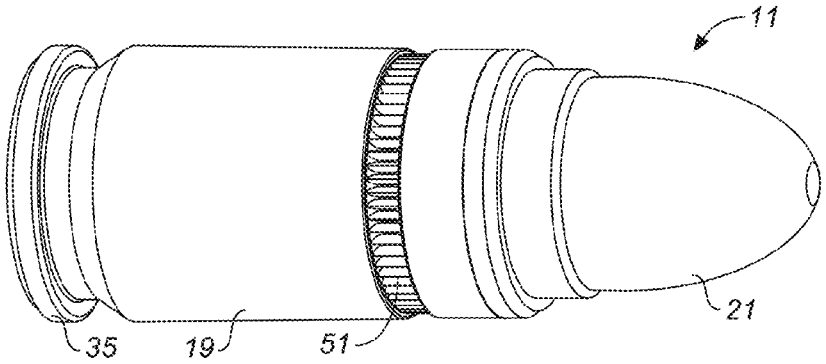
FIG. 1
FIG. 2A
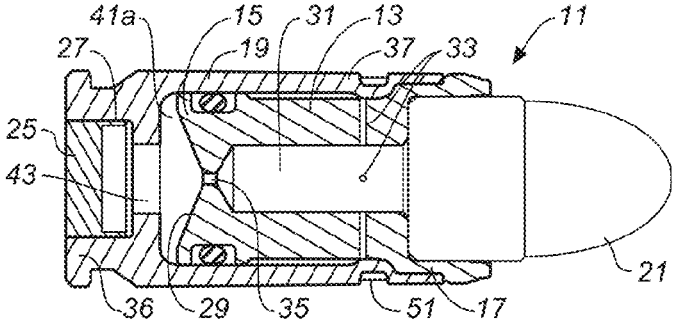
FIG. 2B
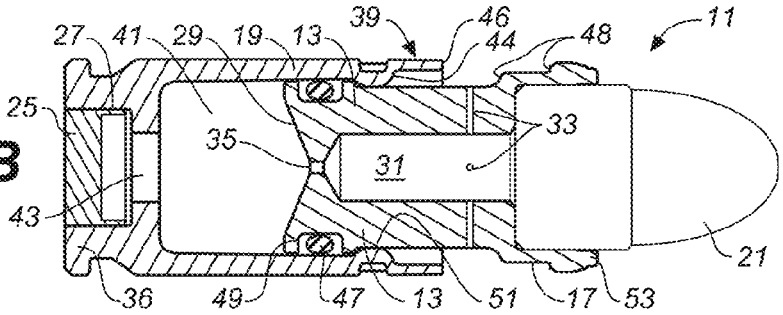
FIG. 2C
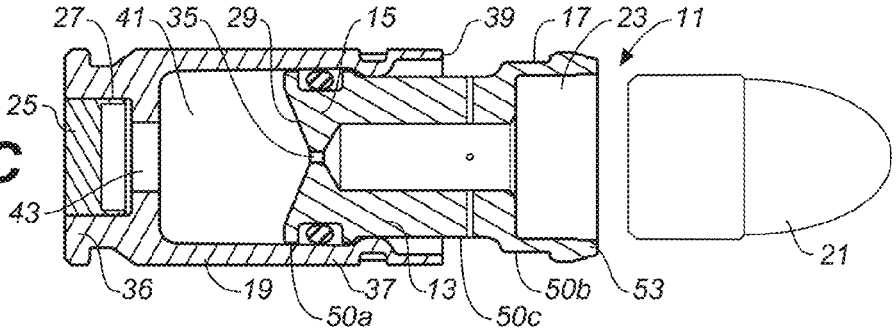

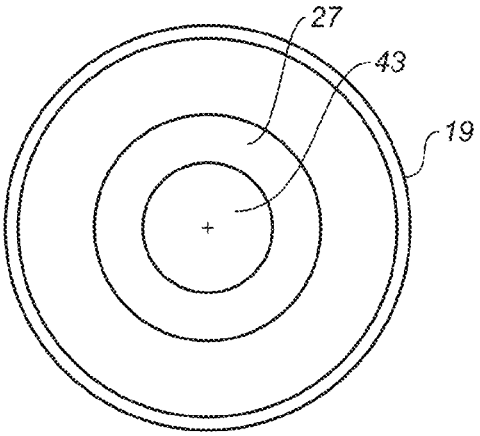
FIG. 7
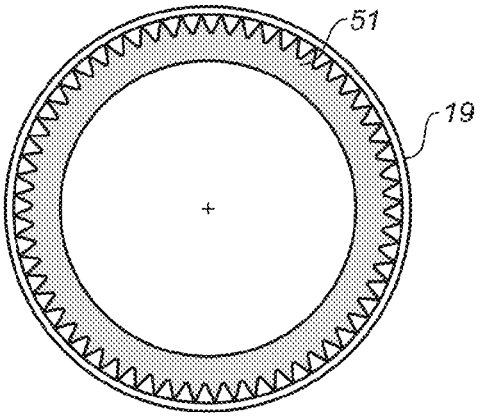
FIG. 8
FIG. 9
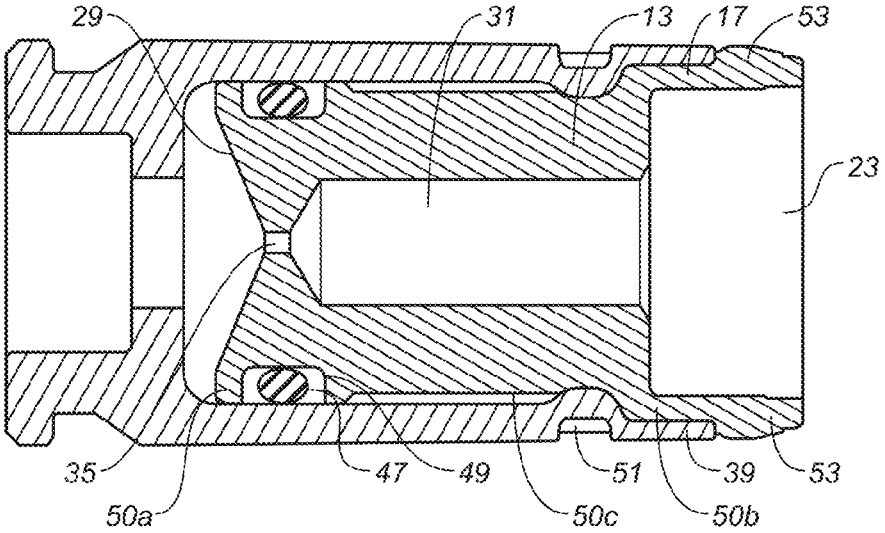
FIG. 10
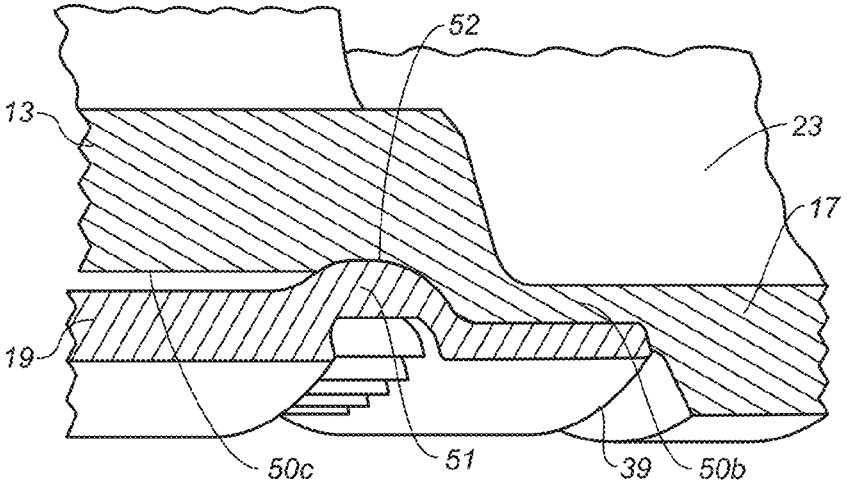

LOW ENERGY MECHANICAL OPERATING CARTRIDGE

CROSS-REFERENCE TO RELATED APPLICATION

This application claims the benefit of U.S. Provisional Application No. 61/752,337 filed Jan. 14, 2013, which is incorporated herein by reference.

BACKGROUND

The present invention generally relates to cartridges for firearms and more particularly relates to low-energy training cartridges capable of launching non-lethal projectiles designed for reality based training, such as for law enforcement and the military.

When training military and law enforcement personnel it is desirable to provide situational environments that are as realistic as possible without creating undue risks of injury or death. Such training most often involves the use of firearms and the shooting of firearms at targeted individuals that role-play the "bad guys." Use of conventional live ammunition in such training exercises creates unacceptable risks of injury or death. On the other hand, the use of blank ammunition inhibits the ability to create realistic "live" stress environments. To help create effective training programs, special cartridges have been developed which fire bullets from firearms at low, non-lethal velocities. Such cartridges allow more realistic situational conditions to be created during training exercises and provide a means short of lethal live ammunition of knowing whether shots fired by the trainees have hit their intended targets.

However, existing non-lethal low-energy training cartridges do not always function reliably or with consistent ballistic accuracy, and particularly consistent accuracy within the given distance parameters. Existing low energy cartridges can also be relatively difficult to manufacture within desirable cost constraints.

The present invention provides an improved low energy mechanical operating cartridge ("MOC") for use in firearm training exercises, which operates reliably and which can be manufactured at an acceptable cost. An MOC in accordance with the invention requires no propellant (ignitable powder) other than the propellant provided by a single primer staked into a primer casing of the MOC. MOCs in accordance with the invention further provide improved control over bullet velocity, and provide greater flexibility in the choice of materials used for the internal components of the MOC.

SUMMARY OF INVENTION

The invention is directed to a low energy mechanical operating cartridge comprised of three essential parts, namely, an inner regulator core, a primer casing and a projectile (or bullet). The regulator core acts to control the velocity at which the bullet is propelled from the firearm, and the primer casing carries the explosive propellant necessary to generate the required energy to launch the bullet. To permit proper operation of the cartridge and ejection of the cartridge from the firearm, the primer casing is configured to efficiently slide on the regulator core in a rearward recoil action, while robust gas seals are maintained between the casing and regulator core.

More particularly, the regulator core of an MOC in accordance with the invention has a base end with a gas regulator hole, a firewall at its base end, and a projectile end having a projectile pocket for holding the projectile at the core's projectile end. A gas flue provided behind the projectile end extends through the regulator core from the core's base end to its projectile pocket. The regulator hole in the base end controls the amount of propellant gas admitted to the gas flue, thereby controlling the propellant force exerted on the projectile after detonation.

The regulator core has sidewalls which include a full diameter sealing wall portion at its base end, a full diameter wall portion at its projectile end, and a reduced diameter wall portion between its full diameter wall portions which forms a travel channel in the core's sidewalls. The full diameter sealing wall portion preferably is a sealing O-ring wall portion with an O-ring fitted into an O-ring groove located at the core's base end. By providing the gas seal at the base end of the regulator core, the seal is advantageously located near the combustion chamber behind the regulator core's firewall.

The primer casing of the MOC has a closed casing head, an open mouth end, and casing walls which extend forward from said casing head to the casing mouth end. The casing walls form a chamber into which the regulator core is fitted base end first so as to join the regulator core and casing in an operative sliding engagement. The head includes a primer pocket for a primer and a flash hole between the primer pocket and the core chamber. Upon detonation of the primer, propellant gases explode into the casing chamber and against the core's firewall through said flash hole in the casing head. This initiates the discharge of the MOC.

The chamber of the casing has a diameter complimentary to the diameter of the full diameter wall portions of the regulator core, such that the walls of the casing that engage over the regulator core engage the full diameter wall portions of the regulator core on either side of the regulator core travel channel.

To provide efficient control over the travel of the casing during recoil, the casing is provided with an intermediate crimp, preferably a cannelure crimp, inboard of the mouth end of the casing. The primer casing is slidably engaged over the base end of the regulator core such that the intermediate crimp in the casing walls engages in the travel channel of the regulator core sidewalls, and such that the full diameter sealing wall portion of the regulator core acts as a stop that limits the travel of the casing over the regulator core when the primer in the casing head is detonated.

The location of the gas seal and crimp and the design of the crimp provide an efficient gas seal and reliable operation of the MOC upon discharge.

BRIEF DESCRIPTION OF THE DRAWINGS

FIG. 1 is a perspective view of a first embodiment of a low energy mechanical operating cartridge in accordance with the invention.

FIG. 2A is a cross-sectional view thereof showing the MOC in a stage before firing (stage 1).

FIG. 2B is a cross-sectional view thereof showing the MOC in a stage at the point of firing and showing the casing of the MOC recoiling from the MOC's inner regulator core (stage 2).

FIG. 2C is a cross-sectional view thereof showing the stage 2 MOC with the low velocity bullet being propelled away from the MOC's regulator core.

FIG. 7 is a front elevational view thereof as seen from lines 7-7 in FIG. 3.

FIG. 8 is a cross-sectional view thereof taken along section lines 8-8 of FIG. 3.

FIG. 9 is a cross-sectional view of the fitted together primer casing and regulator core parts of an MOC in accordance with the alternative embodiment of FIGS. 3-9.

FIG. 10 is an enlarged fragmentary perspective view of the crimp region of the fitted together primer casing and regulator core shown in FIG. 9.

DETAILED DESCRIPTION OF ILLUSTRATED EMBODIMENTS

Figure 2D:
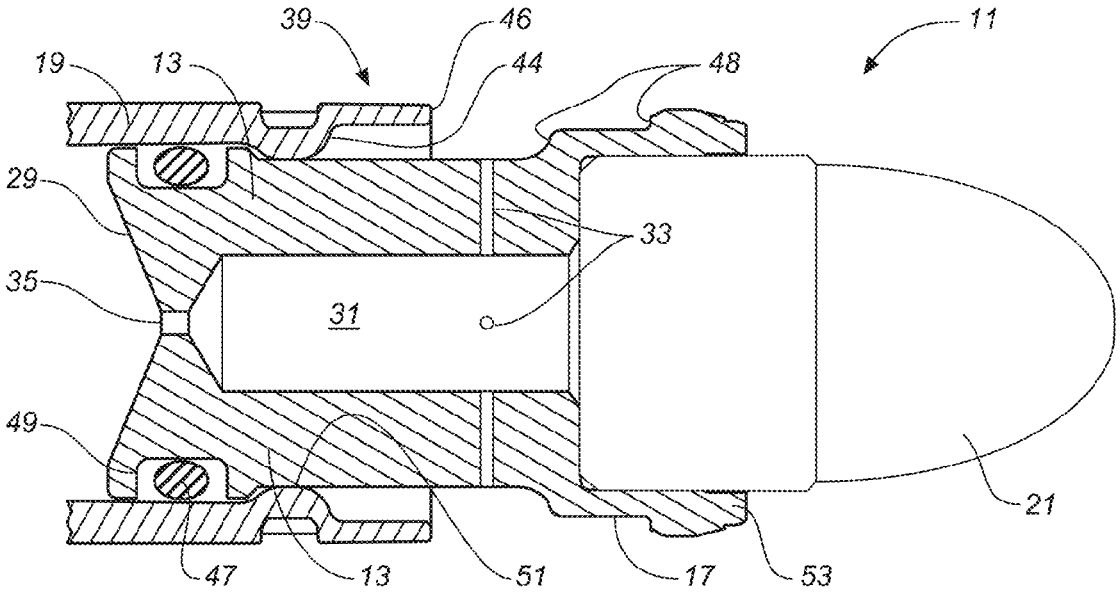
FIG. 2D is an enlarged view of a portion of the MOC shown in FIG. 2B.
Figure 3:
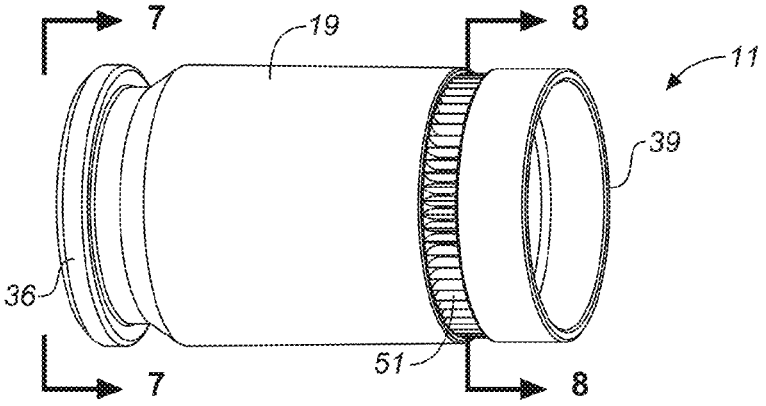
FIG. 3 is a perspective view of the primer casing for an alternative embodiment of a low energy mechanical operating cartridge in accordance with the invention.
Figure 4:
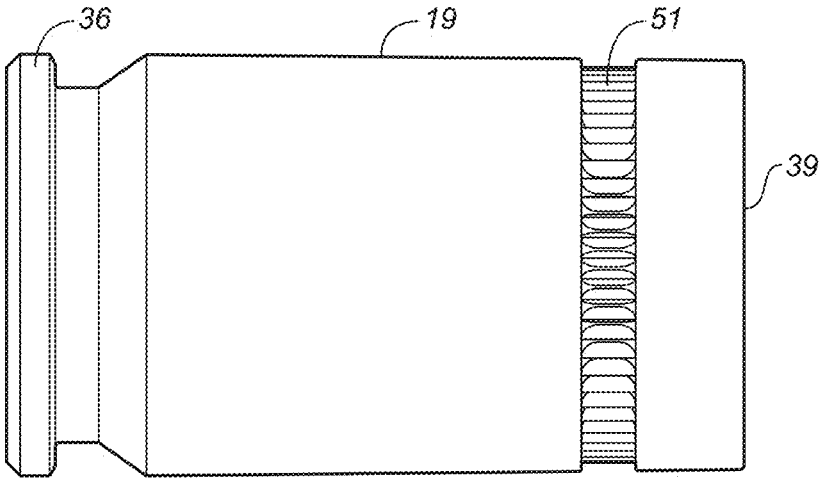
FIG. 4 is a side elevational view thereof.
Figure 5:
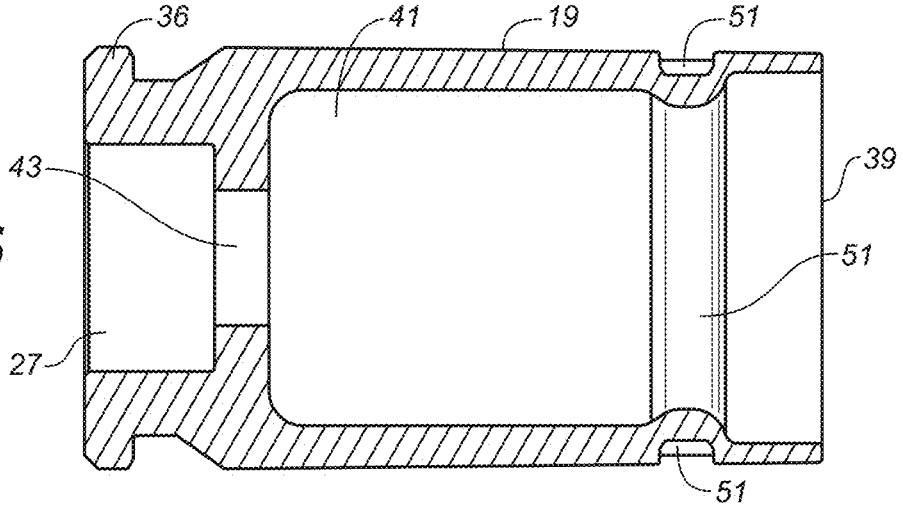
FIG. 5 is a cross-sectional view thereof.
Figure 6:
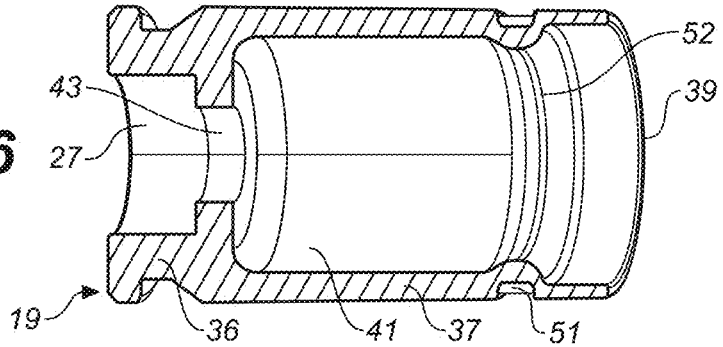
FIG. 6 is another cross-sectional view thereof reduced in scale and shown at a perspective angle.
Figure 11A:
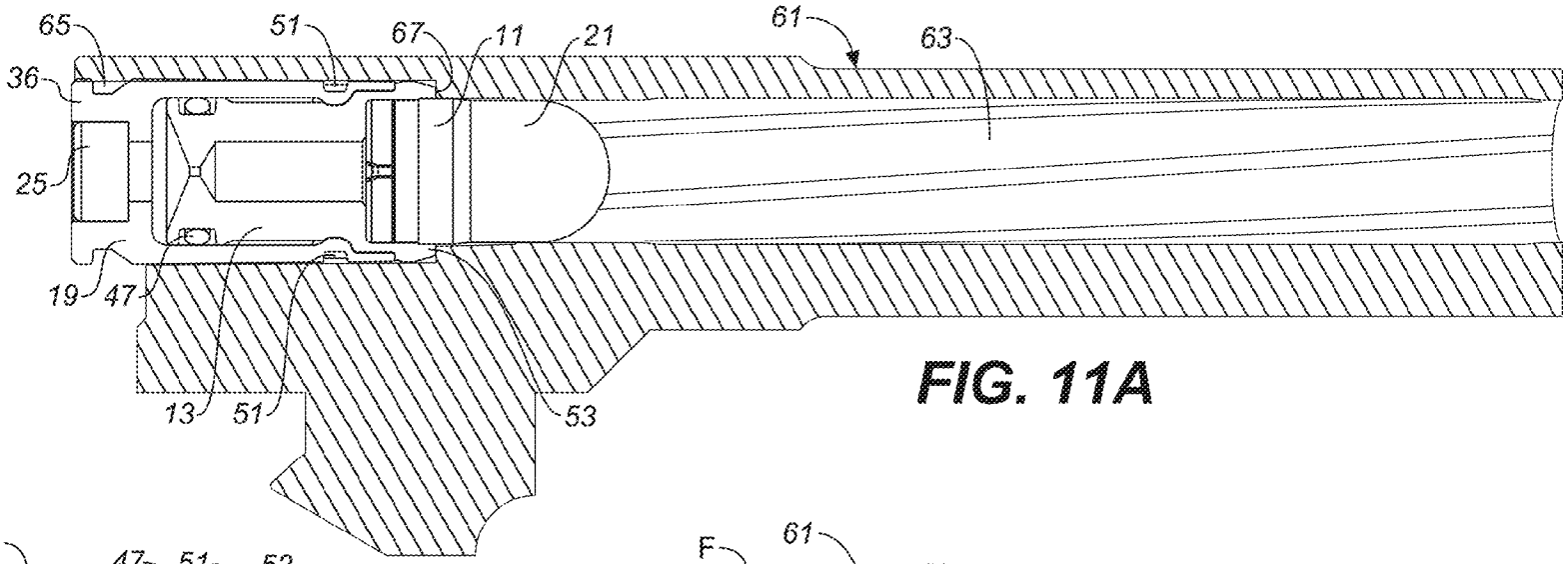
FIG. 11A is a graphical representation in cross-section of a firearm having a low energy mechanical operating cartridge in accordance with the invention chambered in the firearm, and showing the MOC before detonation.
Figure 11B:
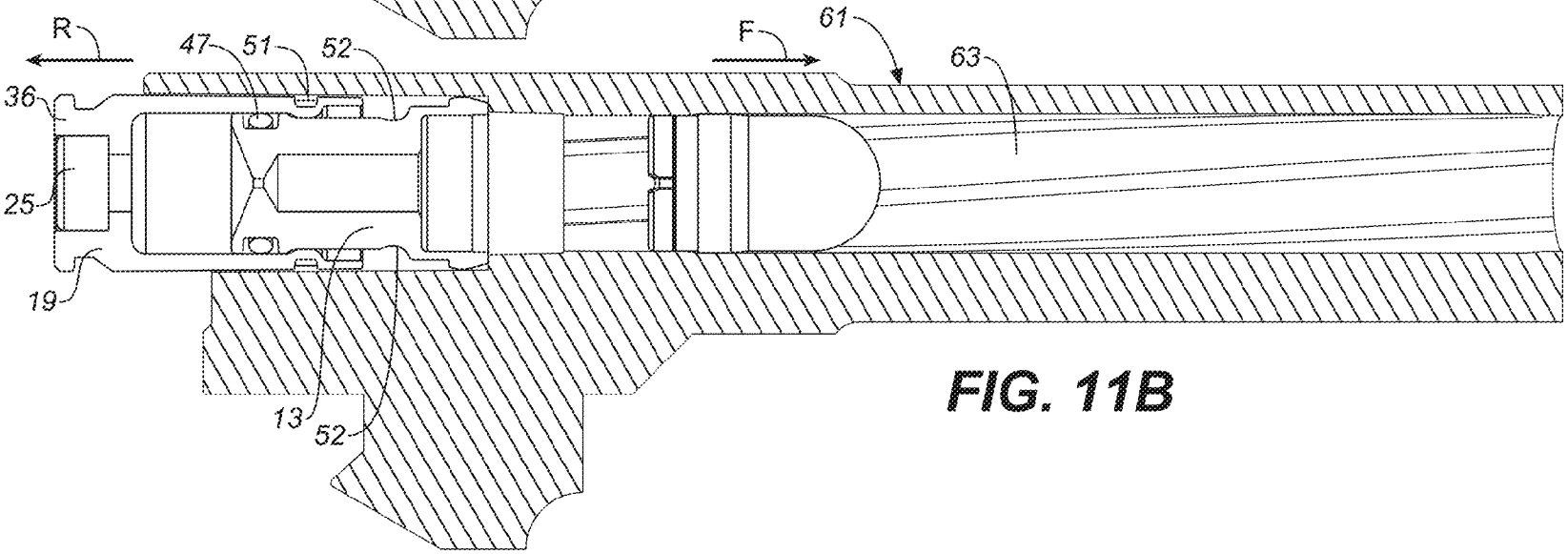
FIG. 11B is the same graphical representation thereof but showing the cartridge after detonation.
Figure 12A:
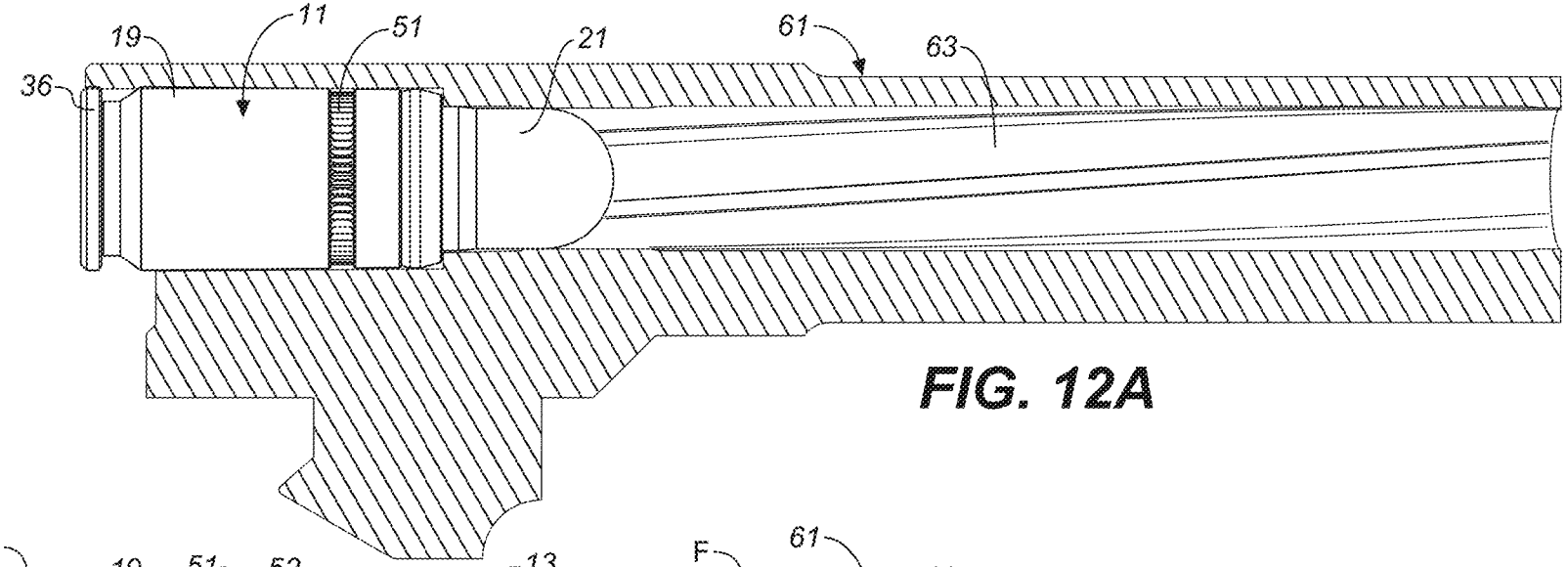
FIG. 12A is another graphical representation thereof which for illustrative purposes shows the MOC not in cross-section.
Figure 12B:
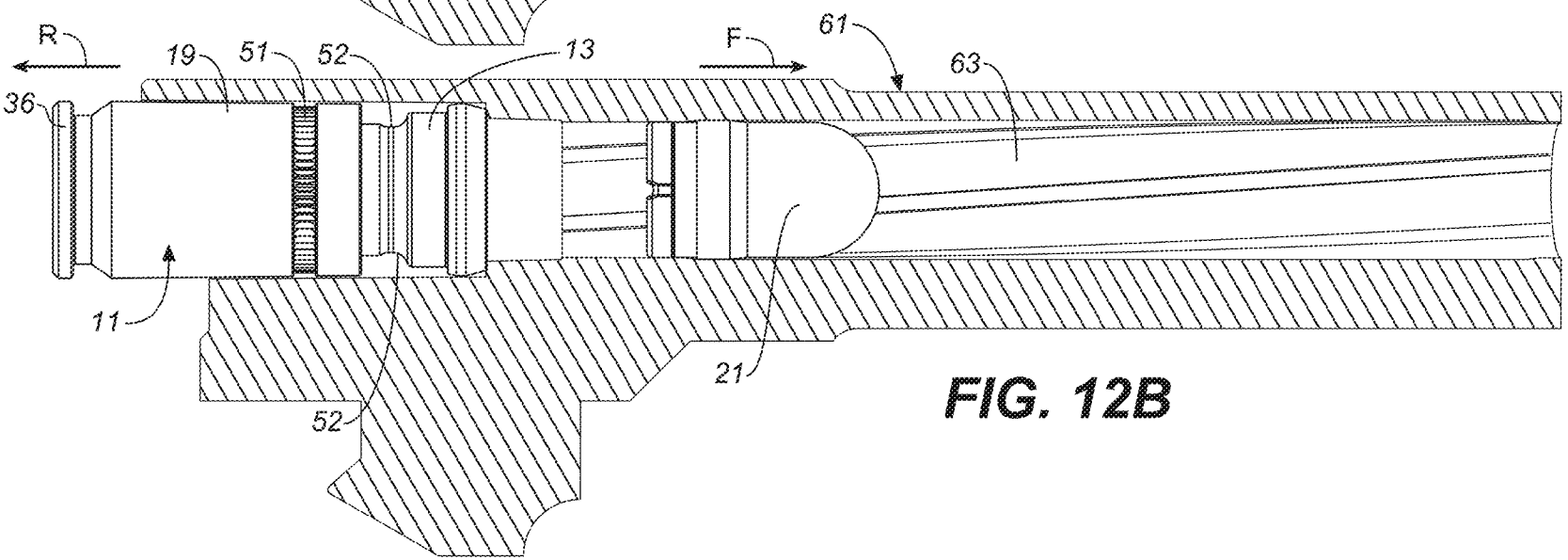
FIG. 12B is the same graphical representation thereof, but showing the MOC after detonation.

Referring now to the drawings, FIGS. 1 and 2A-2C show a first embodiment of a mechanical operating cartridge (MOC) made in accordance with the invention. The MOC, denoted by the numeral 11, is generally comprised of a regulator core 13 having a base end 15 and projectile end 17, an outer casing 19 slidably engaged on the regulator core, and a projectile (bullet) 21 fitted in a bullet pocket 23 on the regulator core's projectile end. When detonated, the primer (propellant unit) 25 embedded in the primer pocket 27 of the casing head 36 provides the propellant energy necessary to push the bullet held on the regulator core from the firearm. The energy regulating characteristics of the regulator core hereinafter described in greater detail regulates the propellant energy that pushes the bullet and permits the bullet to be fired at low, non-lethal velocities.

The design of the sliding parts of the MOC described herein uniquely provides for reliable operation of the MOC. The casing 19 is allowed to efficiently slide relative to the regulator core 13 while providing an effective gas seal between these two dynamic parts. At the same time, effective and reliable stops are provided that limit the travel of the casing over the core element. As described herein, the controlled mechanical sliding engagement of the casing on the regulator core allows the casing to recoil when the primer is detonated, which in turn permits efficient ejectment of the MOC from the firearm cartridge chamber.

The regulator core is seen to have a generally concave firewall 29 at its base end 15 and an internal gas flue 31 that extends from the core's base end to its projectile pocket 23 to provide a contained volume behind the bullet. Upon detonation of the primer, rapidly expanding propellant gases are introduced into the gas flue through a regulator hole 35 in the core's base end 15. (The firewall's concave shape acts to focus the explosive energy of the detonated primer toward the regulator hole for this purpose.) The regulator hole controls the amount of propellant gas permitted to enter the gas flue, and thus the amount and pressure of expanding propellant gas in the gas flue 31 that is available to push the bullet forward. The regulator core, including the size of the regulator hole in the core's firewall, can be designed to ensure that bullet velocities are precisely controlled to stay within non-lethal ranges. Additional vent holes 33 can be provided in the regulator core to achieve additional control over the propellant gas pressures generated in the core. The vent holes are suitably located near the projectile end of the regulator core and suitably extend radially out from the gas flue to the sidewalls of the core so as to vent the gas flue to atmosphere when the primer casing recoils to the stage 2 position shown in FIGS. 2B and 2C. Four vent holes are shown spaced ninety degrees apart, but it will be understood that fewer or more vent holes could be provided as desired to meet particular design criteria.

In regards to the primer casing, it is noted that the primer pocket 27 in the head 36 of the casing is situated behind the base end 15 of the MOC's regulator core 13. Casing walls 37 extend axially behind this casing head and terminate at an open mouth end 39. The casing head and walls form a chamber 41 within the casing into which the regulator core fits, base end first, when the casing is engaged over the regulator core. The primer pocket communicates with this chamber through a flash hole 43. Crimp 51 forms a forward-facing crimp stop face 44 and the casing mouth end 39 forms a forward-facing mouth end stop face 46. The regulator core 13 includes two stepped rearward-facing stop walls 48 that abut the crimp and mouth end stop faces 44, 46 when the regulator core is fully received in the chamber 41 as best seen in FIG. 2D.

The propulsion regulating regulator core 13 of MOC 11 can suitably be either aluminum or a polymer. The casing 19, however, is most suitably fabricated of metal, such as brass, copper, or aluminum. A metal casing is generally required to permit "staking" of the primer in the casing's primer pocket 27. Staking of the primer will prevent primer back-out caused by internal pressures developed within the cartridge during detonation.

To better understand the operation of the MOC, reference is made to FIGS. 2A-2C, wherein FIG. 2A shows the pre-firing stage of the MOC 11 before the primer 25 is detonated (stage 1), and FIGS. 2B and 2C show the mechanical operation and position of parts of the cartridge immediately after detonation (stage 2). As shown in FIG. 2A, at stage 1 the primer casing 19 is fully engaged over the regulator core 13 such that the core's base end 15 is just forward of the casing head 36 and of the primer in the casing head. At this pre-detonation stage, a small combustion chamber 41*a* exists between the casing head and the regulator core's firewall 29. Upon detonation of the primer, the propellant gas explodes through flash hole 43 against the core's firewall, simultaneously pushing the primer casing rearward in a recoil action and introducing propulsion gases to the inner gas flue of the regulator core (stage 2), whereupon the pressure of the propellant gases in the core's gas flue propels the bullet forward at low velocity as shown in FIG. 2C.

As indicated above, reliable operation of the MOC 11 depends on an effective and reliable gas seal existing between the casing 19 and the regulator core 13, and upon a reliable mechanism being provided for limiting the travel of the casing over the regulator core upon detonation of the primer. In the illustrated MOC, a gas seal and travel limiting mechanism is efficiently provided at the interface between the walls of the regulator core and the primer casing. A positive gas seal is preferably provided at the base end 15 of the regulator core, suitably by an O-ring 47 fitted in O-ring groove 49 in the core's sidewall. Such a seal is close to the MOC's stage 1 combustion chamber and prevents propellant gases from forcing their way between the regulator core and casing.

To provide a travel limiting mechanism, it is first seen that the sidewalls of the regulator core are configured such that O-ring wall portion 50*a* at the core's base end is a full diameter wall portion which is complementary to the diameter of the casing chamber 41. A full diameter wall portion 50*b* is also provided at the projectile end 17 of the core, which is similarly complementary to the diameter of casing chamber 41 at the mouth end 39 of the casing. Between these two full diameter wall portions is a reduced diameter wall portion. This reduced diameter wall portion provides an intermediate travel channel 50*c* engaged by a crimp 51 in the casing walls 37. Full diameter wall portions 50*a*, 50*b* provide stops for the crimp as the casing travels over the regulator core; the full diameter sealing sidewall portion 50*a* prevents the casing 19 from separating from the regulator core 13 upon detonation.

Crimp 51, which can be referred to as an "intermediate crimp," is seen to be located inboard of mouth end of the primer casing, and is most suitably a generally U-shaped cannelure crimp. The cannelure crimp thusly located provides a number of advantages in achieving reliable operation of the cartridge. Its U-shape configuration presents a relatively large amount of material to impact a stop. It contacts the regulator core, and particularly the travel channel of the regulator core, over a large surface area, permitting positive engagement with the core's sidewall surfaces with relatively small sliding resistance. And unlike other types of crimps, such as a roll crimp, cannelure crimps can be highly effective when used with either a metal or polymer regulator core, thus allowing the regulator core to be fabricated of different materials. Still further, a cannelure crimp, unlike a roll crimp, can readily be provided in different widths and depths as may be needed to accommodate different design requirements.

It is noted that the projectile end 17 of the regulator core 13 can have an enlarged seating rim 53 for seating in the cartridge chamber of a firearm as further described below. This seating rim will also provide a seat for the mouth end 39 of the casing at the stage 1 condition described above.

FIGS. 3-10 illustrate a second embodiment of the invention that is very similar to the embodiment illustrated in FIGS. 1 and 2A-2C. In the embodiment shown in FIGS. 3-10, the regulator core 13 does not have the vent holes 33 of the embodiment shown in FIGS. 2A-2C, but such vent holes could be added. Also, it is shown that a detent 52 can be added in the travel channel 50*c* of the regulator core, and most suitably at the forward end of the travel channel. Detent 52 is located such that the crimp 51 engages the detent when the primer casing is fully engaged over the regulator core in a stage 1 condition, and is formed such that the detent offers a mild resistance to casing pull-back prior to detonation.

It is noted that the regulator core and particularly the bullet pocket of the regulator core can be sized and configured to accommodate different caliber bullets. Examples of calibers and bullet sizes that could be used in an MOC in accordance with the invention are 9 mm, 5.56 mm (rifle round) and .308 and .40 calibers.

FIGS. 11A, 11B, 12A, and 12B illustrate the chambering of an MOC in accordance with the invention in a firearm (stage 1) and the firing of the MOC (stage 2). In these figures, the firearm, denoted by numeral 61, is shown as having a barrel 63 and a cartridge chamber 65. The MOC 11 is seated in the cartridge chamber against an annular seating shoulder 67 at the chamber end of barrel 63. In this chambered positioned it is seen that the seating rim 53 at the projectile end of the MOC's regulator core comes into contact with the firearm chamber's seating shoulder 67, preventing further forward travel of the MOC in the chamber. Upon detonation of the MOC's primer 25, the MOC's primer casing 19 recoils rearward in the chamber as denoted by arrow R in FIGS. 11B and 12B, while the projectile (bullet) is propelled forward at low velocity down barrel 63 as denoted by arrow F. The low propellant energy that is imparted to the bullet and which results in the bullet leaving the firearm's barrel at a low, non-lethal velocity is achieved by the above-described energy regulating properties of the regulator core.

As earlier described, the MOC 11 chambered within the firearm 61 has a reliable and effective gas seal between its dynamic parts, namely, between the regulator core 13 and primer casing 19, while providing for a controlled recoil capability without part separation. The positive gas seal, such as provided by O-ring 47, is advantageously located near the combustion chamber 41*a* just forward of the primer 25, while the crimp 51 and regulator core travel channel 50*c* are advantageously located and configured to provide an effective engagement of dynamic parts that facilitate ejection of the MOC from the firearm's cartridge chamber after each firing.

While the present invention has been described in considerable detail in the foregoing specification and the accompanying drawings, it will be appreciated that versions of the invention other than those described herein are possible that would fall within the spirit and scope of this disclosure. It is not intended that the invention be limited to the details of the embodiments described herein, unless necessitated by the claims that follow this specification.

What we claim is:

1. A low energy mechanical operating cartridge comprising:

a casing having a closed casing head, cylindrical casing walls, an open casing mouth, and a circumferential intermediate crimp located between said casing head and said casing mouth, said casing mouth having a casing mouth diameter and a forward-facing mouth end stop face, said casing walls defining a core-receiving chamber, said intermediate crimp having a crimp diameter smaller than said casing mouth diameter, and said crimp forming a forward-facing crimp stop face, said mouth end stop face having a diameter greater than that of said crimp stop face, and a regulator core having a base end, sidewalls, and a projectile end for receiving a projectile, said regulator core slidingly received in the core-receiving chamber of said casing, said base end in sealing engagement with the casing walls of said casing, said projectile end in sliding engagement with the casing mouth of said casing, the projectile end of said regulator core including dual, stepped, rearward-facing stop walls for abutment with said mouth end and crimp stop faces when said regulator core is received in said chamber, and said sidewalls including a travel channel extending between and having a diameter smaller than those of said base and projectile ends, said intermediate crimp engaging the sidewalls of the regulator core along said travel channel and movable therein between said base and projectile ends thereby limiting travel of the casing over the regulator core when the casing recoils on the regulator core upon detonation of a primer in the casing head.

2. The low energy mechanical operating cartridge of claim 1 wherein the intermediate crimp in the casing walls is a cannelure crimp.

3. The low energy mechanical operating cartridge of claim 1 wherein a crimp receiving detent is provided in the travel channel in said regulator core sidewalls for setting the position of the primer casing on the regulator core prior to detonation.

4. The low energy mechanical operating cartridge of claim 3 wherein the travel channel in said regulator core sidewalls has a forward end inbound of the core's projectile end and wherein said crimp receiving detent is located at the forward end of said travel channel.

5. The low energy mechanical operating cartridge of claim 1 wherein said regulator core has a base end positioned toward the closed casing head of said casing when the regulator core is engaged in said casing, and wherein the sealing portion of the sidewalls of said regulator core is provided at the base end of said regulator core.

6. The low energy mechanical operating cartridge of claim 1 wherein the base end of the regulator core has an O-ring groove and an O-ring in said O-ring groove for providing sealing engagement between said regulator core and casing.

7. The low energy mechanical operating cartridge of claim 6 wherein:

the base end of said regulator core includes dual, axially spaced-apart sealing walls, defining between them said O-ring groove, each sealing wall in sealing engagement with the casing walls of said casing.

8. The low energy mechanical operating cartridge of claim 1 wherein vent holes are provided in the regulator core for venting the gas flue of the regulator core to atmosphere when the primer casing recoils on the regulator core.

9. The low energy mechanical operating cartridge of claim 8 wherein:

said vent holes are sealed off by said crimp prior to detonation, and are opened upon detonation immediately after the casing recoils on said regulator coil a distance approximately equal to the longitudinal dimension of said crimp.

10. The low energy mechanical operating cartridge of claim 1 further comprising:

said base end positioned toward the closed casing head of said casing when the regulator core is engaged in said casing, and said base end having an O-ring groove and an O-ring fitted in said O-ring groove for providing a sealing engagement between said regulator core and said casing.

11. The low energy mechanical operating cartridge of claim 10 wherein a crimp receiving detent is provided in the travel channel in said regulator core walls for setting the position of the casing on the regulator core prior to detonation.

12. The low energy mechanical operating cartridge of claim 11 wherein the travel channel in said regulator core sidewalls has a forward end inbound of the core's projectile end and wherein said crimp receiving detent is located at the forward end of said travel channel.

13. The low energy mechanical operating cartridge of claim 10 wherein vent holes are provided in the regulator core for venting the gas flue of the regulator core to atmosphere when the primer casing recoils on the regulator core.

14. The low energy mechanical operating cartridge of claim 1 wherein:

said casing mouth end axially overlaps a rear portion of a projectile received in the projectile end of said regulator core.

15. The low energy mechanical operating cartridge of claim 1 wherein:

the sidewalls of said regulator core along said travel channel are spaced inwardly from said casing walls.

16. The low energy mechanical operating cartridge of claim 1 wherein:

said casing walls between said casing head and said intermediate crimp having a casing walls diameter greater than said crimp diameter.

17. The low energy mechanical operating cartridge of claim 16 wherein:

said casing mouth diameter is greater than said casing walls diameter.

18. The low energy mechanical operating cartridge of claim 17 wherein:

said casing mouth extends forward from said intermediate crimp to said mouth end stop face.

19. The low energy mechanical operating cartridge of claim 1 wherein:

said intermediate crimp has a casing wall diameter that is larger than said crimp diameter, and said casing mouth diameter is larger than said casing wall diameter.

20. A low energy mechanical operating cartridge comprising:

a casing having a closed casing head, cylindrical casing walls, an open casing mouth, and a circumferential intermediate crimp located between said casing head and said casing mouth, said casing mouth having a casing mouth diameter, said intermediate crimp having a crimp diameter smaller than said casing mouth diameter, and a regulator core formed to slidably engage in said casing, said regulator core having a base end positioned toward the closed casing head of said casing when the regulator core is engaged in said casing, said base end having an O-ring groove and an O-ring fitted in said O-ring groove for providing a sealing engagement between said regulator core and said casing, said regulator core further having a recessed travel channel, a projectile end for receiving a projectile, a gas flue, and vent holes extending radially from the gas flue to the travel channel substantially at the location of the crimp prior to detonation for venting the gas flue to atmosphere when the casing recoils on the regulator coil, said intermediate crimp engaging in the travel channel in the core sidewalls such that said travel channel limits the travel of the casing over the regulator core when the casing recoils on the regulator core upon detonation of a primer in the casing head.

21. A low energy mechanical operating cartridge comprising:

a regulator core having a base end, a firewall at said base end, a projectile end having a projectile pocket, an internal gas flue extending from said base end to said projectile pocket, a gas flow regulator hole in the regulator core's base end between said firewall and gas flue, and core sidewalls, said projectile end including dual, stepped rearward-facing stop walls, the core sidewalls having a full diameter wall portion at the base end of said regulator core forming a sealing wall, a full diameter wall portion at the projectile end of said regulator core, a reduced diameter wall portion between said full diameter wall portions, said reduced diameter wall portion forming a travel channel on said core sidewalls bounded by said full diameter wall portions, a projectile releasably held on the projectile end of said regulator core, a casing engaged over the base end of said regulator core, said casing having a closed casing head, an open casing mouth end, and casing walls having a circumference and extending from said casing head to said casing mouth end to form a core receiving chamber therein, said casing head including a primer pocket and a flash hole between said primer pocket and said regulator core chamber, said regulator core being engaged base end first in the core receiving chamber of said casing such that the firewall of said regulator core faces the flash hole in said casing head, wherein, upon detonation of said primer, propellant gases are directed through said casing head flash hole against the firewall of said regulator core, and a primer embedded in the primer pocket in the head of said casing, the regulator core chamber of said casing having a diameter complementary to the diameter of the full diameter wall portions of said regulator core, wherein the walls of the casing that engage the regulator core engage the full diameter wall portions of the regulator core on either side of the regulator core travel channel, said casing having an intermediate crimp around the circumference thereof located between the casing head and the casing mouth end of said casing such that no portion of the cannelure crimp is located at the mouth end of the casing, said casing mouth having a casing mouth diameter and a forward-facing mouth end stop face, and said crimp having a crimp diameter smaller than said casing mouth diameter, said crimp forming a forward-facing crimp stop face, the forward-facing mouth end and crimp stop faces for abutment with the rearward-facing stop walls of the projectile end of said regulator core when said regulator core is received in the chamber of said casing, and said primer casing being slidably engaged over the base end of the regulator core such that the intermediate crimp in the casing wall engages in the travel channel in the core sidewalls and such that the full diameter wall portion of the regulator core at the base end of said regulator core forming a sealing wall acts as a stop that limits the travel of the casing over the regulator core when the casing recoils on the regulator core upon detonation of the primer in the casing head.

22. The low energy mechanical operating cartridge of claim 21 wherein the intermediate crimp in the casing walls is a cannelure crimp.

23. The low energy mechanical operating cartridge of claim 21 wherein a crimp receiving detent is provided in the travel channel in said regulator core walls for setting the position of the primer casing on the regulator core prior to detonation.

24. The low energy mechanical operating cartridge of claim 23 wherein the travel channel in said regulator core sidewalls has a forward end inbound of the core's projectile end and wherein said crimp receiving detent is located at the forward end of said travel channel.

25. The low energy mechanical operating cartridge of claim 21 wherein the full diameter sealing wall portion of the core sidewalls is an O-ring wall.

26. The low energy mechanical operating cartridge of claim 21 wherein vent holes are provided in the regulator core for venting the gas flue of the regulator core to atmosphere when the primer casing recoils on the regulator core.

27. The low energy mechanical operating cartridge of claim 26 wherein said vent holes extend radially through said regulator core from the gas flue of the regulator core to the travel channel in said regulator core sidewalls substantially at the location of the crimp in said casing prior to detonation.

28. A low energy mechanical operating cartridge comprising:

a casing having a closed casing head, an open casing mouth end for a projectile, and casing walls having a circumference, a regulator core formed to slidably engage within said casing, said regulator core having sidewalls, a portion of which contact said casing and a portion of which provides a travel channel which does not contact said casing, and wherein the portion that contacts the casing includes a portion that provides sealing engagement between said regulator core and casing, and said regulator core further having vent holes for venting the gas flue of the regulator core to atmosphere when casing recoils on the regulator core, said casing having an intermediate crimp around the circumference thereof between the head and the mouth ends of the casing, wherein said intermediate crimp engages in the travel channel in the core sidewalls, and wherein said travel channel limits the travel of the casing over the regulator core when the casing recoils on the regulator core upon detonation of a primer in the casing head, the vent holes in said regulator core extending radially through said regulator core from the gas flue of the regulator core to the travel channel in said regulator core sidewalls substantially at the location of the crimp in said casing prior to detonation.

* * * * *